United States Patent [19]

Olsen et al.

[11] Patent Number: 4,726,583

[45] Date of Patent: Feb. 23, 1988

[54] PASSIVE HYDRAULIC RESISTANCE SYSTEM

[75] Inventors: Zenny Olsen, West Hartford; Benny Olsen, Plainville, both of Conn.

[73] Assignee: Olsen Controls, Inc., Bristol, Conn.

[21] Appl. No.: 933,320

[22] Filed: Nov. 19, 1986

Related U.S. Application Data

[63] Continuation of Ser. No. 484,923, Apr. 14, 1983, abandoned.

[51] Int. Cl.[4] ..... A63B 21/00

[52] U.S. Cl. ..... 272/130; 417/313

[58] Field of Search ..... 272/125, 129, 130; 417/279, 313, 404, 440, 534

[56] References Cited

U.S. PATENT DOCUMENTS

| | | | |
|---|---|---|---|
| 3,164,325 | 1/1965 | Veum | 417/404 X |
| 3,465,592 | 9/1969 | Perrine | 272/130 |
| 3,495,824 | 2/1970 | Cuinier | 272/130 |
| 4,063,726 | 12/1977 | Wilson | 272/130 |
| 4,223,706 | 9/1980 | McGahey | 417/404 X |
| 4,326,707 | 4/1982 | Strelker | 272/130 |
| 4,354,676 | 10/1982 | Ariel | 272/129 |
| 4,363,481 | 12/1982 | Erickson | 272/130 X |
| 4,452,447 | 6/1984 | Lepley et al. | 272/130 X |
| 4,478,412 | 10/1984 | Muir | 272/130 |

*Primary Examiner*—Richard J. Apley
*Assistant Examiner*—Robert W. Bahr
*Attorney, Agent, or Firm*—McCormick, Paulding and Huber

[57] ABSTRACT

A exercising machine has a pivotal lever and includes a passive electrohydraulic resistance system which provides controlled resistance to lever movement. Hydraulic fluid which may leak from a piston-cylinder assembly, which comprises part of the system, collects in a sump and is sucked into the piston-cylinder assembly during the normal operating cycle of the exercise machine.

11 Claims, 3 Drawing Figures

PASSIVE HYDRAULIC RESISTANCE SYSTEM

This is a continuation of co-pending application Ser. No. 484,923 filed on Apr. 14, 1983, now abandoned.

BACKGROUND OF THE INVENTION

This invention relates in general to hydraulic systems and deals more particularly with an improved passive hydraulic resistance or damping system of a type which operates in response to an externally applied force to provide controlled resistance to the force. While the hydraulic damping system of the present invention may be useful for many purposes, it is particularly adapted for use in an exercising machine or the like to provide controlled resistance to movement of a member, such as a lever which is manually moved in the performance of an exercising program.

Heretofore various types of closed hyraulic systems have been used in such exercising apparatus. Such hydraulic systems usually include a reservoir or a hydraulic fluid accumulator for receiving hydraulic fluid which is recirculated through the system. It is generally desirable that an exercising machine provide consistently uniform resistive response to specific energy input, however, seal leakage resulting in loss of hydraulic fluid has proven particularly troublesome in such systems. The occurrence of such seal leakage alters the response of the hydraulic system and results in corresponding change in the response of the exercising machine to a specific energy input. Further, when such leakage occurs, hydraulic fluid which escapes from the system must be replenished. Seal replacement often may be required to correct the problem. Further, escape of hydraulic fluid from the system to the surrounding environment is generally undesirable.

Accordingly, it is the general aim of the present invention to provide an improved passive hydraulic resistance system which overcomes the aforesaid problems and which may be regulated to provide controlled response over a wide range of force input conditions.

SUMMARY OF THE INVENTION

In accordance with the present invention, a passive hydraulic resistance system charged with hydraulic fluid comprises a housing and a piston assembly which includes a piston supported for movement in one and an opposite direction within and relative to the housing. The piston assembly further includes connecting means for driving the piston in one and an opposite direction in response to external force applied to the connecting means. The piston assembly cooperates with the housing to define first and second chambers of variable volume separated from each other by the piston. The piston is movable within and relative to the housing to simultaneously decrease the volume of one of the chambers and increase the volume of the other of the chambers. The system includes fluid conduit means which defines flow paths between the chambers and a sump containing a quantity of hydraulic fluid. Control means connected to the conduit means regulates resistance to hydraulic flow from either of the chambers. The system further includes means for directing fluid flow from either of the chambers through the control means, and means for allowing fluid to flow from the sump to either of the chambers in response to suction in either of the chambers to replenish fluid in either of the chambers, as may be required to maintain the integrity of the system.

DETAILED DESCRIPTION OF PREFERRED EMBODIMENTS

Figure 1:
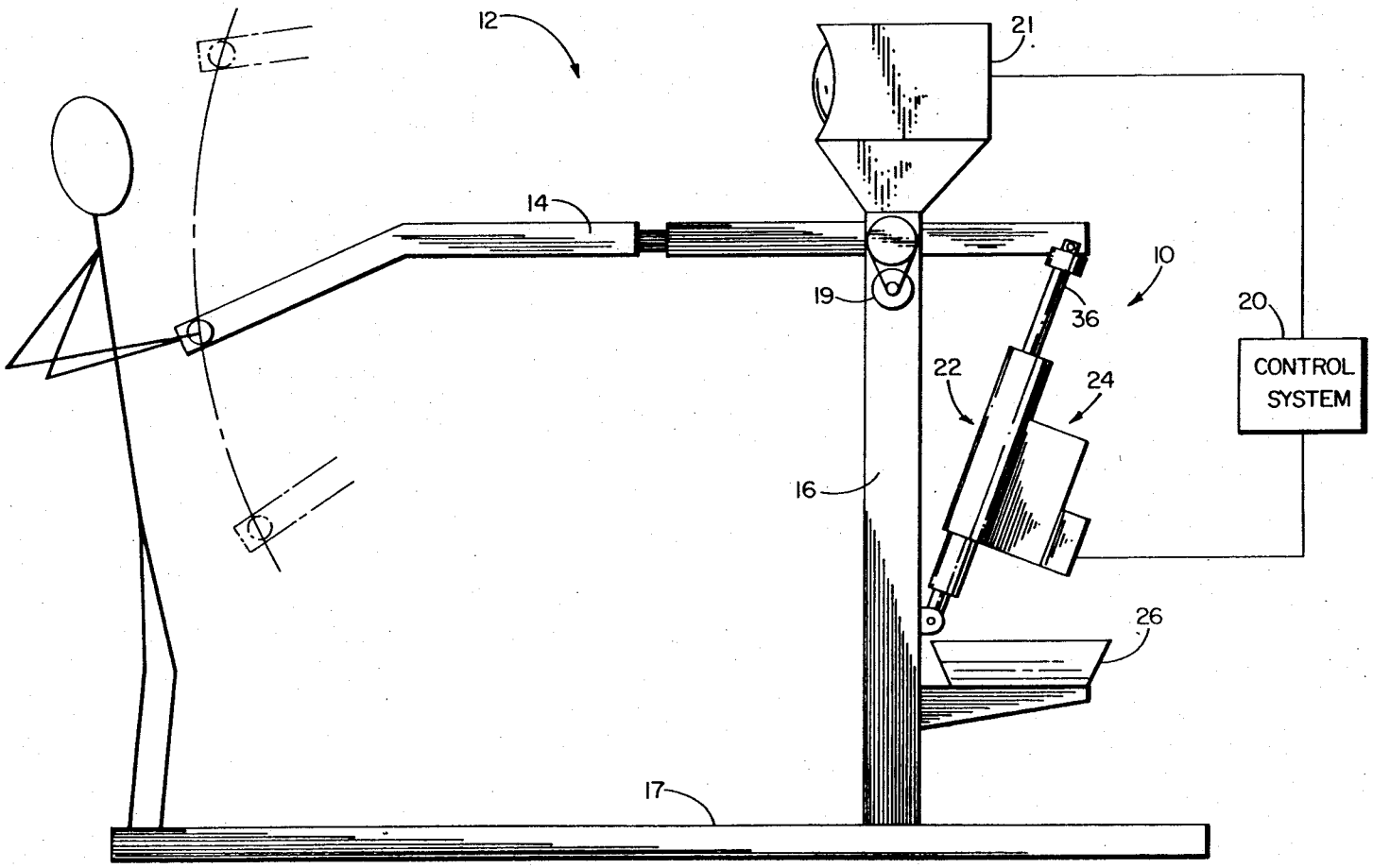
FIG. 1 is a somewhat schematic side elevational view of an exercising machine including a passive hydraulic resistance system embodying the invention.

Turning now to the drawings, and referring first particularly to FIG. 1, a passive hydraulic resistance system embodying the present invention and indicated generally by the reference numeral 10 comprises a part of an exercising apparatus, designated generally by the numeral 12. The exercising apparatus 12 essentially comprises a movable part or lever 14 pivotally supported intermediate its ends at the upper end of a vertical support 16 or pedestal rigidly attached to an exercise platform 17. The lever is supported for pivotal movement in one and an opposite direction between limits, indicated in phantom, in response to exercise force applied to a handle 18 mounted at one end of the lever 14. The system 10 is connected between the other end of the lever 14 and the pedestal 16 to resist pivotal movement of the lever in either direction relative to the support 16. The illustrated system 10 is an electrohydraulic system constructed and arranged to provide resistance to lever movement in either direction, as will be hereinafter more fully discussed. As shown, the system is connected to a microcomputer based controller which comprises part of a control system 20, which includes an angular position transducer 19 connected to the controller for indicating the angular position of the lever 14. The control system may be programmed to control response of the exercising machine 12.

The results of the exercise performed are displayed on the screen of a monitor 21 mounted at the top of the pedestal 16. The monitor in one preferred form of the invention comprises a conventional television set which receives RF video and audio signals from the computer.

Figure 2:
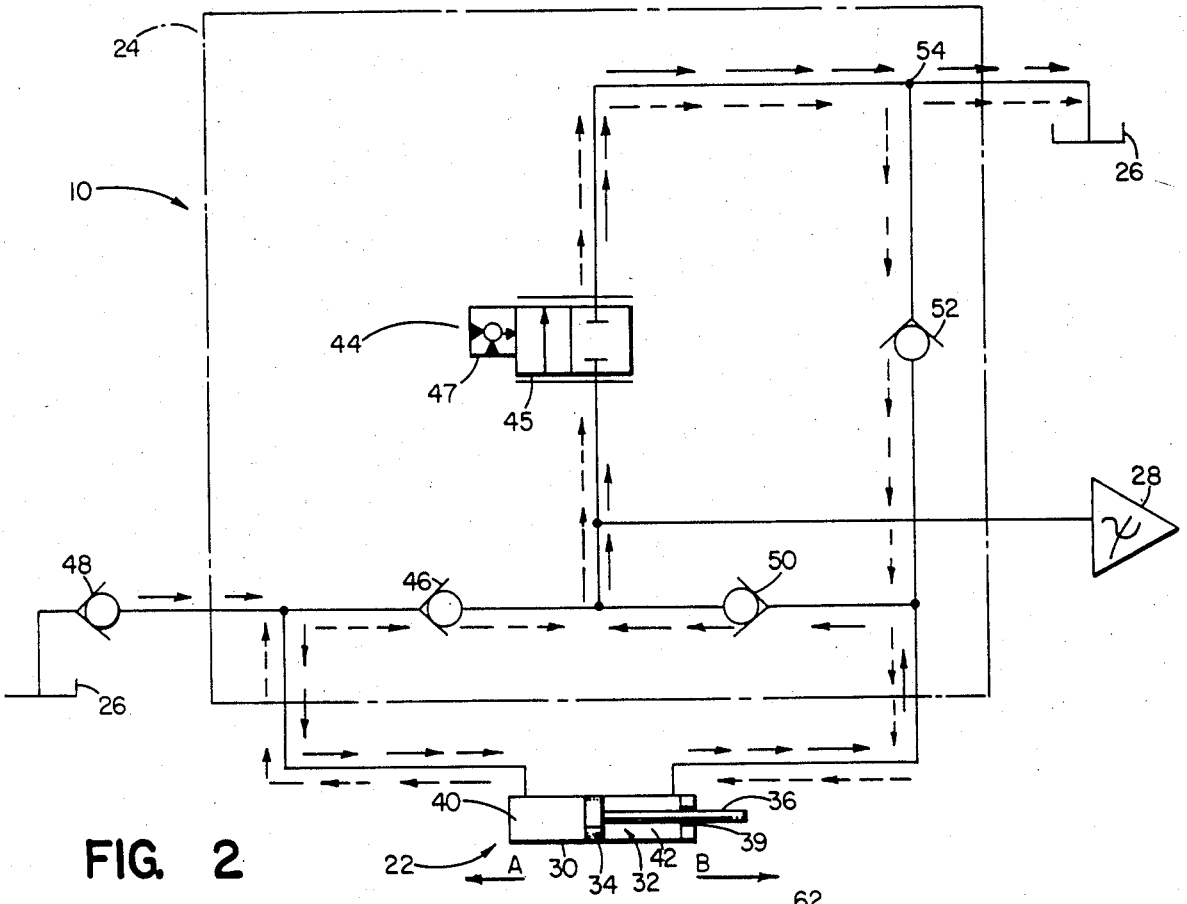
FIG. 2 is a diagrammatic view of the passive hydraulic resistance system shown in FIG. 1.

Referring now to FIG. 2, the passive hydraulic resistance system 10, shown in FIG. 1, is diagrammatically illustrated and generally comprises a piston-cylinder assembly, indicated generally at 22, connected to a passive hydraulic resistance device, designated generally by the numeral 24. The illustrated system 10, which is charged with hydraulic fluid, further includes a strategically located sump 26, a control means or electrohydraulic servovalve, indicated generally at 44, for regulating hydraulic fluid flow within the system and a sensing device or transducer 28 for providing an output signal indicative of the condition of the system, as will be hereinafter further discussed.

The piston-cylinder assembly 22 has a housing or cylinder 30 and a piston assembly 32 which includes a piston 34 supported for movement in one and an opposite direction within and relative to the cylinder, and a connecting rod 36 for driving the piston in response to an externally applied force. The connecting rod 36 is attached to the piston 34 within the cylinder 30 and projects through an opening in one end of the cylinder. A seal ring 39 disposed within the latter opening cooperates in sealing relation with an associated portion of the connecting rod 36 to prevent escape of hydraulic fluid from the cylinder 30.

The piston assembly 32 cooperates with the cylinder 30 to define first and second chambers of variable volume indicated at 40 and 42, respectively, and separated from each other by the piston 34. The piston is movable within and relative to the cylinder to simultaneously decrease the volume of one of the chambers 40 and 42, whereby fluid is expelled from the one chamber, and increase the volume of the other of the chambers, whereby suction may be developed within the other of the chambers. It should be noted that since the connecting rod 36 is attached to the piston 34 within the chamber 42, the effective area of the piston within the chamber 42 is equal to the total cross sectional area of the piston 34 less the cross sectional area of the connecting rod 36. Thus, the piston 34 displaces a greater volume of hydraulic fluid in moving in one direction, indicated by the letter A, than in moving through an equal distance in the opposite direction, indicated by the letter B in FIG. 2.

Fluid conduits, which may comprise passageways formed within a body of the resistance device 24 or individual fluid lines which connect the various elements which comprise the system 10, define flow paths between the chambers 40 and 42 and the sump 26. Hydraulic fluid is constrained to flow along the paths defined by the various fluid lines and through the servovalve 44 in response to movement of the piston 34 in either direction within and relative to the cylinder 30. The servovalve 44 regulates resistance to hydraulic fluid flow from either of the chambers 40 and 42 and essentially comprises a two-way spool valve 45 controlled by a step motor 47. A further disclosure of a servovalve of the type presently preferred in practicing the invention is found in U.S. Pat. No. 4,235,156 to Zenny Olsen, co-inventor in the present application, which is hereby adopted by reference as part of the present disclosure.

A check valve 46, disposed within fluid flow path from the chamber 40 to the servovalve 44, directs fluid flow from the latter chamber to and through the servovalve 44 when the servovalve is in an open position and prevents reverse flow from the servovalve to the chamber 40. Another check valve 48, connected in a return flow path from the sump 26 to the chamber 40, allows fluid to flow from the sump to the chamber 40 in bypassing relation to the servovalve 44.

Still another check valve 50, disposed in a path of hydraulic fluid flow from the chamber 42 to the servovalve 44, directs fluid flow from the chamber 42 to and through the servovalve 44 and prevents flow from the servovalve to the chamber 42. Yet another check valve 52 disposed within a flow path from the sump 26 to the chamber 42 allows fluid to flow from the sump to the chamber 42 in bypassing relation to the servovalve 44, however, the check valve 52 prevents fluid flow from the chamber 42 to the sump in bypassing relation to the servovalve.

The illustrated sensing device 28 comprises a pressure transducer connected in the path of fluid flow between the piston-cylinder assembly 22 and the servovalve 44 on the pressure side of the servovalve. The transducer 28 responds to pressure developed within the system caused by movement of the piston 34 in either direction relative to the cylinder 30.

Movement of the piston 34 in the direction A, in response to external force applied to the connecting rod 36 by pivoting the lever 14 in one direction, decreases the volume of the chamber 40 to expel fluid from the chamber 40 which travels along a path indicated by broken flow arrows in FIG. 2. Fluid passes through the check valve 46 and to and through the open servovalve 44. The check valve 48 prevents hydraulic fluid from flowing to the sump 26 in response to movement of the piston in the direction A, while the check valve 50, prevents fluid from flowing directly from the chamber 40 to the chamber 42 in bypassing relation to the servovalve. Thus, when the piston is moved in the direction A, hydraulic fluid is constrained to flow from the chamber 40 to and through the servovalve 44.

Movement of the piston 34 in the direction A also causes increase in the volume of the chamber 42 creating suction within the latter chamber. After passing through the servovalve 44, some of the fluid flows from the servovalve and along a path indicated by broken flow arrows in FIG. 2, passes through the check valve 52, and returns to the chamber 42. Because the effective surface area of the piston 34 within the chamber 40 is somewhat greater than the effective surface area of the piston within the chamber 42, a greater volume of fluid is expelled from the chamber 40 than can be received within the chamber 42 when the piston moves in the direction indicated by the arrow A. For this reason the return flow path from the servovalve 44 is divided at a junction 54 so that some fluid which flows from the servovalve in response to movement of the piston in direction A is discharged into the sump 26.

When the piston 34 is moved in the direction of the arrow B, by pivoting the lever 14 in the opposite direction, fluid is expelled from the chamber 42 and travels along a flow path indicated by full line flow arrows in FIG. 2. The check valve 50 allows fluid to flow from the chamber 42 to and through the open servovalve 44 to the sump 26. The check valves 46 and 52 cooperate to prevent fluid flow from the chamber 42 to the sump in bypassing relation to the servovalve.

Movement of the piston in the direction B increases the volume of the chamber 40 and creates suction within the latter chamber causing fluid to be drawn from the sump 26 through the check valve 48 and returned to the chamber 40 along a return flow path indicated by full line flow arrows in FIG. 2. The force required to move the piston in either direction or the velocity of lever motion may be precisely controlled by regulating the servovalve 44.

In accordance with the invention, the sump 26 is strategically located relative to the piston-cylinder assembly 22 to receive such hydraulic fluid as may leak past the seal 39 and escape from the cylinder 30. A preferred arrangement of the sump is shown somewhat schematically in FIG. 1, wherein the sump is located generally below the piston-cylinder assembly 22 so that any fluid which escapes from the cylinder will flow by gravity to the sump. During each stroke of the piston 34 in the direction B some fluid is drawn from the sump 26. Thus, any fluid which leaks from the cylinder into the sump will be replenished by fluid sucked into the cylinder from the sump. It will now be evident that the system is self-priming in that any fluid which leaks from the cylinder will be automatically replenished during normal operation of the system.

The pressure transducer 28 is connected to the pressure side of the servovalve 44 and provides a signal to the controlling computer. The transducer may be calibrated to provide a direction readout of the force required to move the piston 34.

Figure 3:
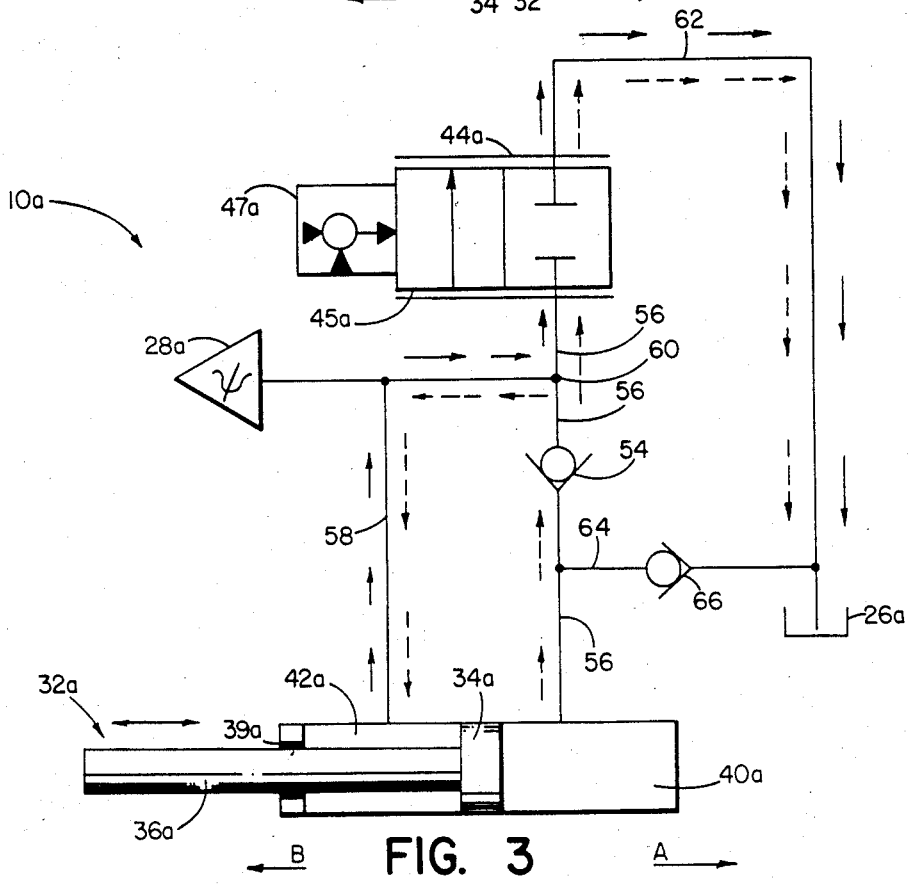
FIG. 3 is similar to FIG. 2, but shows another passive hydraulic resistance system embodying the invention.

Referring now to FIG. 3, another passive hydraulic resistance system embodying the present invention in indicated generally at 10a. The system 10a is similar in many respects to the system 10, previously described, but differs therefrom in the construction and arrangement of the piston-cylinder assembly 22a and in the number and arrangement of check valves which determine the paths of fluid flow within the system. Parts of the system 10a which correspond to parts of the system 10, previously described, bear the same reference numerals as the previously described parts and a letter "a" suffix and will not be hereinafter further described.

In the system 10a, the piston 34a has an effective surface area within the chamber 40a which equals twice the effective surface area of the piston within the chamber 42a. Thus, the piston 34a displaces twice the volume of fluid in moving in the direction of the arrow A as in moving through an equal distance in the direction of the arrow B.

A check valve 54 connected in an hydraulic line 56 between the chamber 40a and the servovalve 44a allows fluid to flow from the latter chamber to and through the open servovalve, but prevents reverse flow to the chamber. Another hydraulic line 58, connected to the line 56 at a junction 60, provides flow paths between the chamber 42a and the juction 60. Still another hydraulic line 62 defines a discharge flow path from the outlet side of the servovalve 44a to the sump 26a. A return flow path from the sump to the chamber 40a is defined by an hydraulic line 64 connected to the line 56 between the check valve 54 and the chamber 40a. A check valve 66 disposed within the line 64 allows fluid to flow from the sump 26a to the chamber 40a in bypassing relation to the servovalve 44a, but prevents fluid flow from the chamber 44a to the sump in bypassing relation to the servovalve. A pressure transducer 28a is connected to the line 56 on the pressure side of the servovalve.

When the piston moves in the direction of the arrow A, in response to force applied to the connecting rod 36a, fluid is expelled from the chamber 40a and flows through the line 56 and through the check valve 54 along a flow path indicated by broken flow arrows in FIG. 3. The flow divides at the junction 60. Some of the fluid flows along a path defined by the hydraulic line 58 and flows to the chamber 42a at the suction side of the piston. The remainder of the fluid is forced to flow through the servovalve 44a and travels along the line 62 to the sump 26a.

Reverse movement of the piston in the direction of the arrow B expels fluid from the chamber 42a which flows along a path indicated by full line flow arrows to and through the servovalve 44a and to the sump 26a. Fluid is simultaneously sucked from the sump 26a through the line 64 and through the check valve 66 into the chamber 40a at the suction side of the piston. It will now be evident that due to the 2 to 1 ratio of the effective surface areas of the piston 34a within the chambers 40a and 42a and the relative arrangement of the flow paths, movement of the connecting rod 36a through an equal distance in either direction will cause substantially the same quantity of fluid to flow through the servovalve 44. Thus, with the servovalve in any fixed position of adjustment, the system will respond in an identical manner to movement of the lever 14 in either direction.

As previously discussed, the sump 26a is located to receive fluid leakage from the piston-cylinder assembly 22a. In the event of such leakage, the hydraulic fluid charge within the piston-cylinder assembly will be replenished automatically during the suction portion of the system cycle.

We claim:

1. A passive hydraulic resistance system charged with hydraulic fluid and comprising a housing and a piston assembly including a piston supported for movement in one and an opposite direction within and relative to said housing and connecting means in the form of a connecting rod for driving said piston in said one and said opposite direction in response to forces applied to said rod, said piston assembly cooperating with said housing to define first and second chambers of variable volume separated from each other by said piston, said piston and rod being movable within and relative to said housing to simultaneously decrease the volume of one of said chambers and increase the volume of the other of said chambers, said piston and rod displacing a greater volume of fluid in moving in one direction to expel fluid from said first chamber than in moving through an equal distance in an opposite direction within and relative to said housing to expel fluid from said second chamber, a sump for containing a quantity of hydraulic fluid, control valve means for exclusively regulating hydraulic fluid flow within said system, means defining a first flow path from said first chamber to said second chamber, first check valve means for allowing fluid flow along said first path from said first chamber to said second chamber and preventing fluid flow along said first path from said second chamber to said first chamber, means for defining a second flow path from said first chamber to said control valve means, said first check valve means allowing fluid flow from said first chamber along said second flow path to said control valve means and preventing fluid flow along said second flow path to said first chamber, a portion of said first flow path between said first check valve means and said second chamber being connected with the second flow path and thereby with the control valve means and allowing unrestricted fluid flow to and from said second chamber, means defining a third flow path from said control valve means to said sump for allowing fluid flow from said control valve means to said sump, means defining a fourth flow path from said sump to said first chamber in bypassing relation to said control valve means, and second check valve means for allowing fluid flow along said fourth flow path from said sump to said first chamber and preventing fluid flow along said fourth flow path from said first chamber to said sump.

2. A passive hydraulic resistance system as set forth in claim 1 wherein said device includes sensing means connected to said conduit means for providing an output signal indicative of the force applied to said connecting means in moving said piston.

3. A passive hydraulic resistance system as set forth in claim 2 wherein said sensing means comprising a pressure transducer.

4. A passive hydraulic resistance system as set forth in claim 1 wherein said control valve means comprises a servovalve.

5. A passive hydraulic resistance system as set forth in claim 1 wherein said piston displaces twice the volume of fluid in moving in said one direction than in moving in said opposite direction.

6. A passive hydraulic resistance system as set forth in claim 1 wherein said connecting rod attaches to said piston within said housing and projects from said housing through an opening in said housing, and said sump is positioned relative to said opening to receive fluid which may leak from said housing through said opening.

7. A passive hydraulic resistance system as set forth in claim 6 wherein said sump is located below said opening.

8. A passive hydraulic resistance system as set forth in claim 1 wherein said second flow path forms a junction with said first flow path between said first check valve means and said control valve means.

9. A passive hydraulic resistance system as set forth in claim 8 wherein said connecting means comprises a piston rod attached to said piston within said housing and projecting from said housing through an opening in said housing and said sump is positioned relative to said opening to receive fluid which may leak from said housing through said opening.

10. A passive hydraulic resistance system as set forth in claim 9 wherein said sump is located below said opening.

11. A passive hydraulic resistance system charged with hydraulic fluid and comprising a housing and a piston assembly including a piston supported for movement in one and an opposite direction within and relative to said housing and connecting means in the form of a connecting rod for driving said piston in said one and said opposite direction in response to forces applied to said rod, said piston assembly cooperating with said housing to define first and second chambers of variable volume separated from each other by said piston, said piston and rod being movable within and relative to said housing to simultaneously decrease the volume of one of said chambers and increase the volume of the other of said chambers, said piston and rod displacing a greater volume of fluid in moving in one direction to expel fluid from said first chamber than in moving through an equal distance in an opposite direction within and relative to said housing to expel fluid from said second chamber, a sump for holding a quantity of hydraulic fluid, control valve means for exclusively regulating hydraulic fluid flow within said system, means defining a first flow path from said first chamber to said second chamber for directing fluid from the first chamber to the second chamber exclusive of the sump and the control valve means, first check valve means for allowing fluid flow along said first path from said first chamber to said second chamber and preventing fluid flow along said first path from said second chamber to said first chamber, means for defining a second flow path from said second chamber to said control valve means, said first check valve means causing fluid flow from said second chamber to move along said second flow path to said control valve means when said piston is moved in said opposite direction within and relative to said housing, said first flow path between said first check valve means and said second chamber also being in fluid communication with the control valve means by way of the second flow path, means defining a third flow path from said control valve means to said sump for allowing fluid flow from said control valve means to said sump, and means defining a fourth flow path from said sump to said first chamber in bypassing relation to said control valve means, and allowing a fluid flow along said fourth flow path from said sump to said first chamber.

* * * * *